US006796835B2

(12) United States Patent
Wu

(10) Patent No.: US 6,796,835 B2
(45) Date of Patent: Sep. 28, 2004

(54) ELECTRICAL CONNECTOR WITH BOARD LOCK

(75) Inventor: Jerry Wu, Irvine, CA (US)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 0 days.

(21) Appl. No.: 10/396,207

(22) Filed: Mar. 24, 2003

(65) Prior Publication Data

US 2004/0009705 A1 Jan. 15, 2004

Related U.S. Application Data

(63) Continuation-in-part of application No. 10/194,121, filed on Jul. 11, 2002, now Pat. No. 6,716,068.

(51) Int. Cl.[7] ..... H01R 13/73
(52) U.S. Cl. ..... 439/567; 439/571
(58) Field of Search ..... 439/567, 571, 439/82, 636

(56) References Cited

U.S. PATENT DOCUMENTS 5,336,111 A * 8/1994 Thrush et al. ..... 439/567
5,551,891 A * 9/1996 Huss, Jr. ..... 439/567

* cited by examiner

*Primary Examiner*—Alexander Gilman
(74) *Attorney, Agent, or Firm*—Wei Te Chung

(57) ABSTRACT

An electrical connector (1) includes an insulating housing (2), a number of terminals (3, 4) retained in the housing and a pair of board locks (5) secured on the housing. The housing defines a pair of receiving spaces (24) at opposite ends thereof and a pair of slots (25) communicating with the receiving spaces, respectively. Each board lock includes a body portion (50) received in the receiving space of the housing, a compliant portion (54) extending from the body portion for being received in a corresponding through hole of a circuit substrate and a beam portion (52) extending from the body portion opposite to the compliant portion. The beam portions are received in the slots of the housing for preventing the board locks from being pushed out from the housing.

8 Claims, 7 Drawing Sheets

ELECTRICAL CONNECTOR WITH BOARD LOCK

CROSS-REFERENCE TO RELATED APPLICATION

This patent application is a continuation-in-part (CIP) of U.S. patent application Ser. No. 10/194,121 filed on Jul. 11, 2002 and entitled "LOW PROFILE ELECTRICAL CONNECTOR HAVING IMPROVED CONTACTS" now U.S. Pat. No. 6,176,068.

BACKGROUND OF THE INVENTION

1. Field of the Invention

The present invention relates to an electrical connector, and particularly to an electrical connector with board locks for positioning the connector on a circuit board.

2. Description of Related Art

There are numerous ways of securing an electrical connector to a circuit board. For example, the connector may be provided with mounting flanges having bores therethrough for accepting threaded mounting bolts that extend through corresponding through holes of the circuit board and are secured by nuts or the like. In many instances, however, it is more desirable to have a board mounting device or board lock that does not require mounting flanges on the connector or the use of tools. In addition, it is desirable to minimize the space on the circuit board such that the board locks for the connector are secured within an insulating housing of the connector.

The board lock secured within the housing typically has a pair of spaced legs with outward barbs. When the board lock is inserted into the through hole of the circuit board, the spaced legs are first compressed to deflect inwardly toward each other and then restore to their original configuration, whereby the barbs latch beneath a bottom face of the circuit board to secure the connector on the circuit board. The design of this board lock cannot accommodate tolerance variations in the thickness of the circuit board since the barbs of the board lock exactly engage with the bottom face of the circuit board.

Other board locks have compliant portions that can be compressed upon insertion of the board lock into the through hole of the circuit board and then resile outwardly to engage surfaces within the through hole. When using the board locks that engage inner surfaces of the through hole, it is desirable to have a high enough retention force to hold the connector on the circuit board. The board lock with a high retention force typically requires a high insertion force, which results in the risk of pushing out the board lock from the housing during the insertion of the board lock into the through hole of the circuit board. As a result, the connector is unreliably positioned on the circuit board and an electrical connection between the connector and the circuit board is adversely affected. U.S. Pat. No. 6,331,122 having the same applicant and the same assignee with the invention, discloses the board lock used with a length-reduced connector. Anyhow, the retention between the housing and the board lock is still desired to be improved.

Hence, an electrical connector with improved board locks is required to overcome the disadvantages of the related art.

SUMMARY OF THE INVENTION

Accordingly, a first object of the present invention is to provide an electrical connector with board locks which can make the electrical connector stably mounted on a circuit board, thereby ensuring a reliable electrical connection therebetween.

A second object of the present invention is to provide an electrical connector with board locks securely retained in an insulating housing thereof for preventing the board locks from being pushed out from the housing during the insertion of the board locks into through holes of a circuit board.

In order to achieve the objects set forth, an electrical connector in accordance with the present invention comprises an insulating housing, a plurality of terminals retained in the housing and a pair of board locks secured on the housing. The housing defines a pair of receiving spaces at opposite ends thereof and a pair of slots communicating with the receiving spaces. Each board lock comprises a body portion received in the receiving space of the housing, a compliant portion extending from the body portion for being received in a corresponding through hole of a circuit substrate and a beam portion extending from the body portion opposite to the compliant portion. The beam portions are received in the slots of the housing for preventing the board locks from being pushed out from the housing during the insertion of the board locks into the through holes of the circuit substrate.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
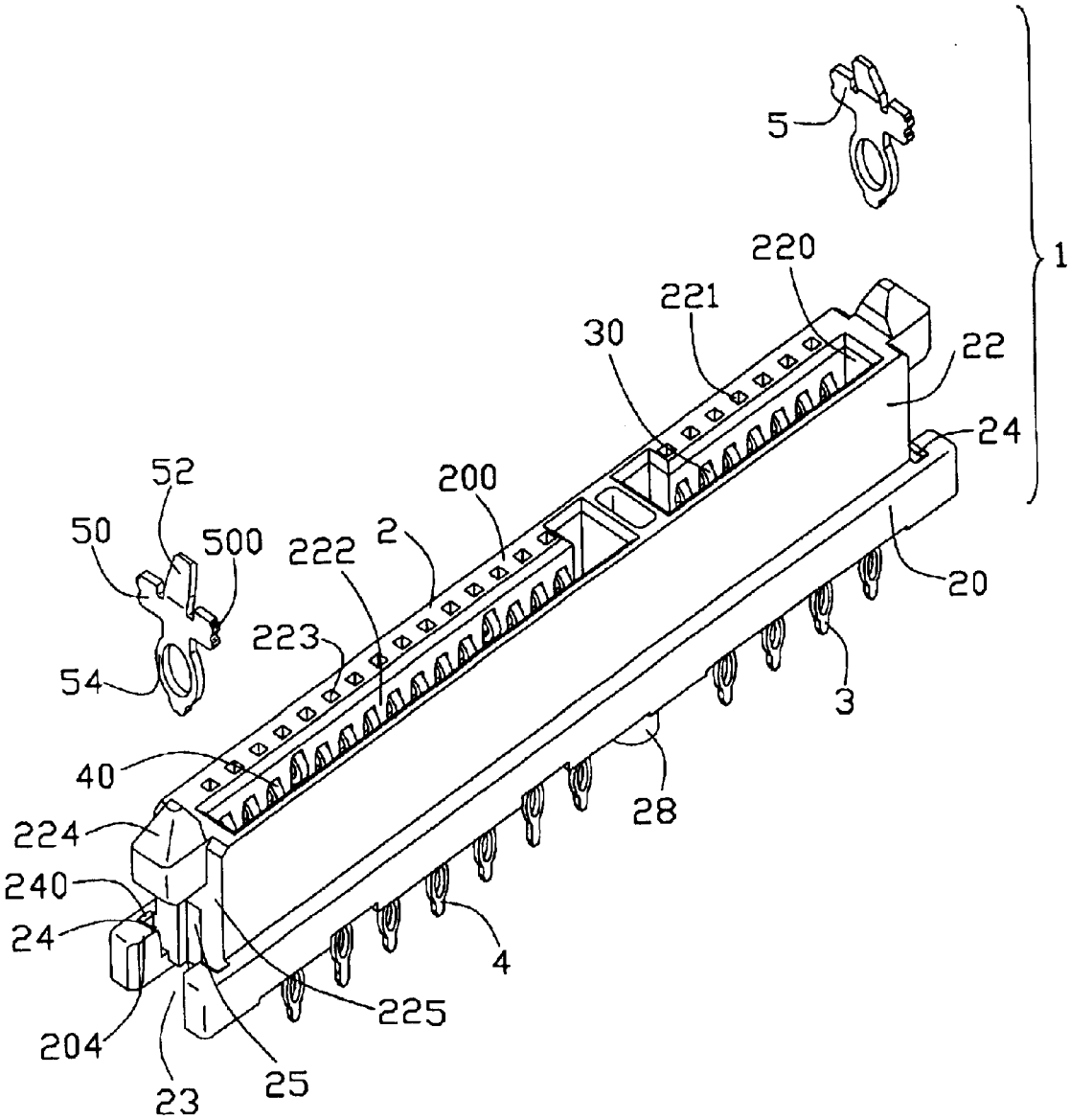
FIG. 1 shows an electrical connector with a pair of board locks in accordance with the present invention unassembled thereto.
Figure 2:
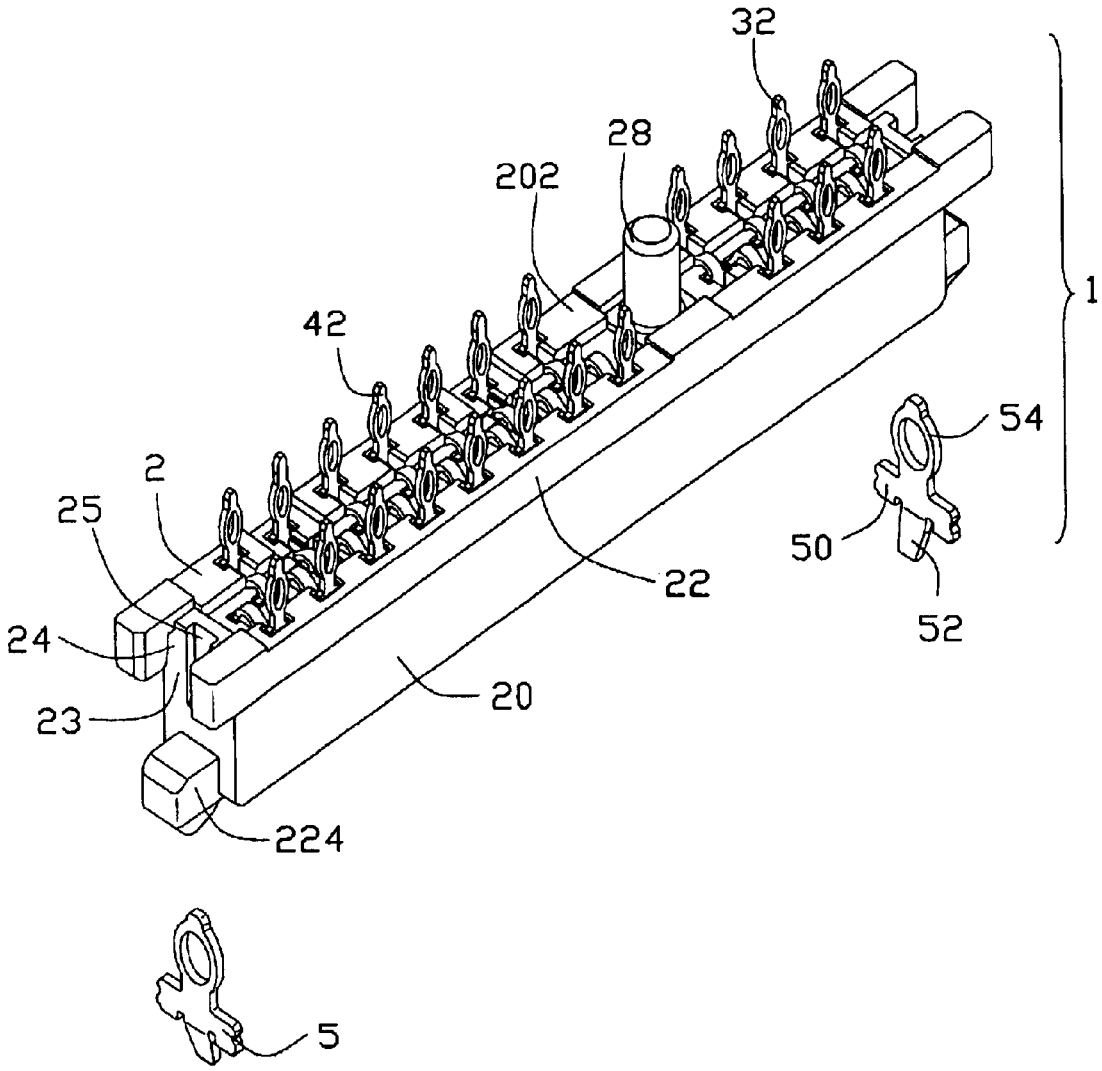
FIG. 2 is a view similar to FIG. 1 but taken from a different perspective.
Figure 3:
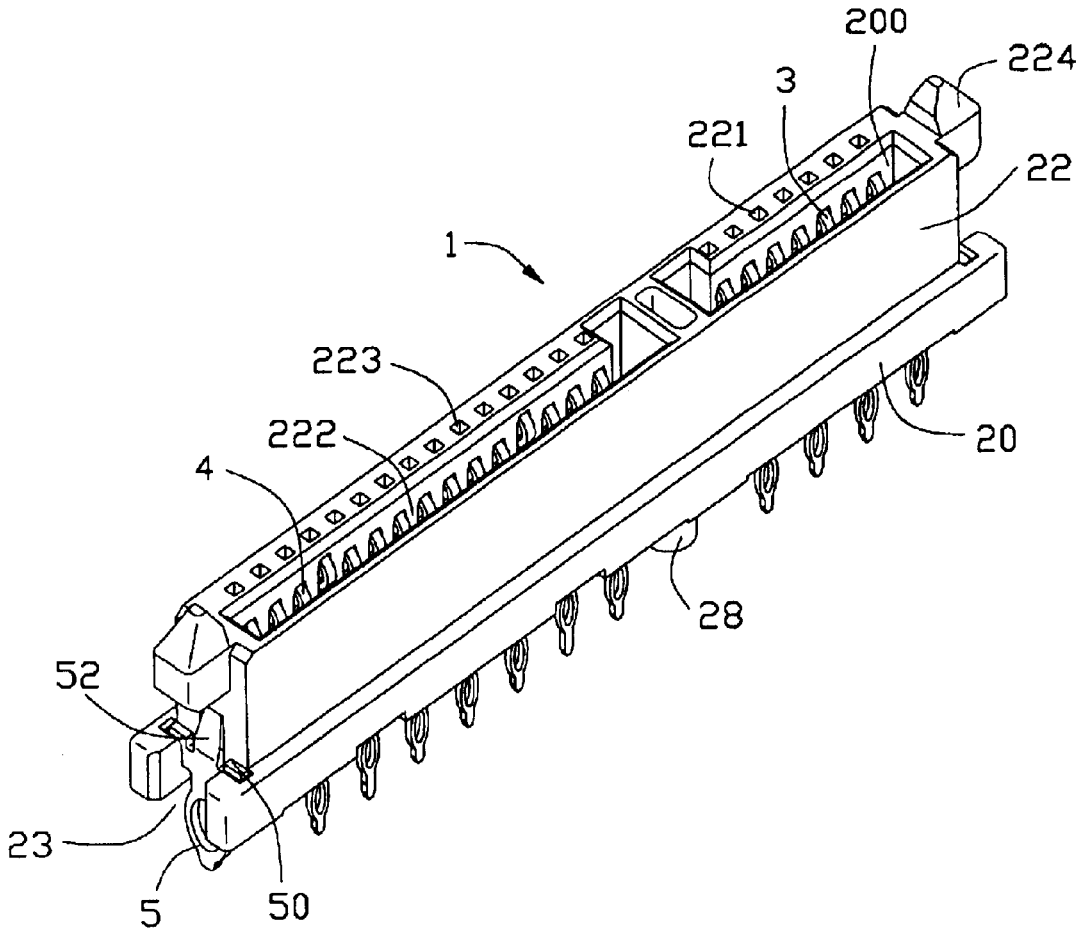
FIG. 3 is a perspective view showing the board locks secured on an insulating housing of the electrical connector.
Figure 4:
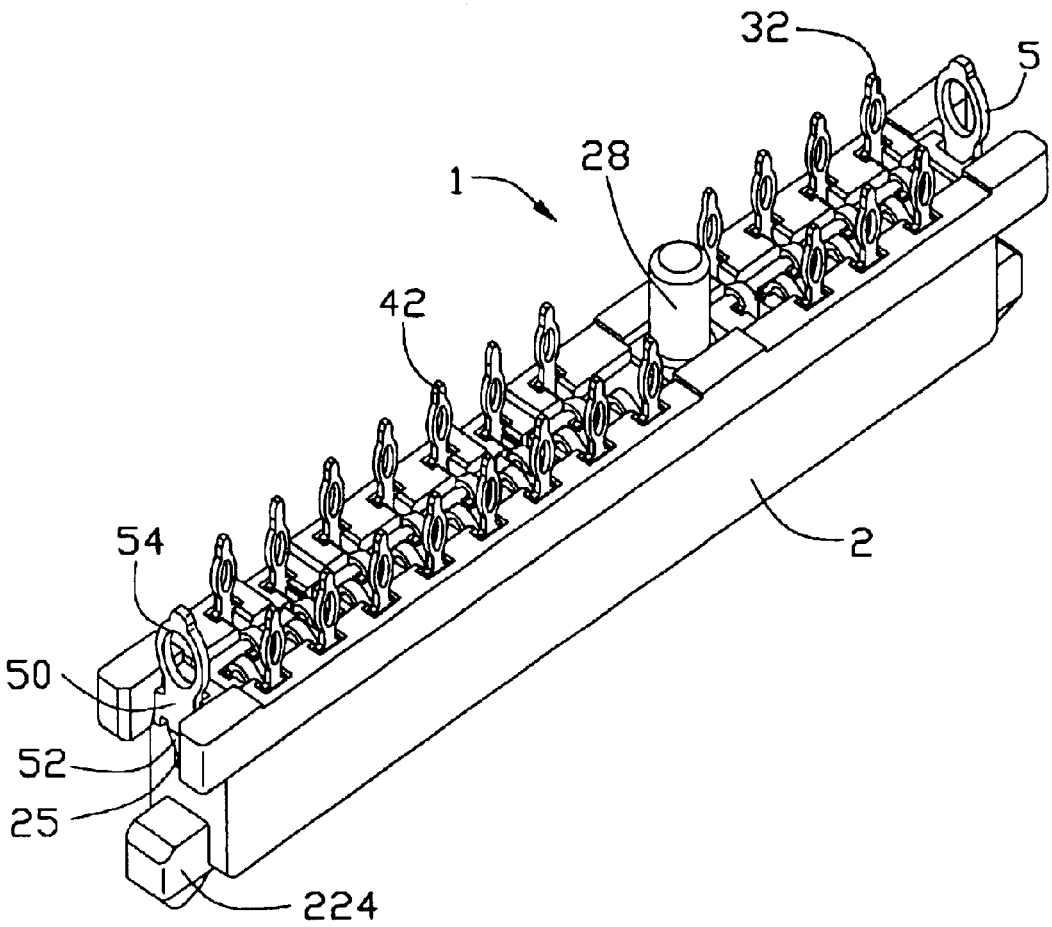
FIG. 4 is a view similar to FIG. 3 but taken from a different perspective.

Referring to FIGS. 1 and 2, an electrical connector 1 for being mounted on a circuit board (not shown) in accordance with the present invention comprises an insulating housing 2, a plurality of first and second terminals 3, 4 retained in the housing 2 and a pair of board locks 5 assembled to the housing 2 for positioning the connector 1 on the circuit board.

The insulating housing 2 is generally of an elongate shape and has a top mating face 200 and a bottom mounting face 202. The housing 2 includes a base portion 20 and a mating portion 22 extending upwardly from the base portion 20. The mating portion 22 defines first and second receiving cavities 220, 222 in the mating face 200. The first receiving cavity 220 has a smaller dimension than the second receiving cavity 222 along a longitudinal direction of the housing 2. A plurality of first and second passageways 221, 223 extend from the top mating face 200 through the bottom mounting face 202 of the housing 2 to respectively communicate with the first and the second receiving cavities 220, 222. The mating portion 22 is formed with a pair of guiding blocks 224 at opposite ends thereof for ensuring a proper engagement between the connector 1 and a complementary connector (not shown). A positioning post 28 projects downwardly from the bottom mounting face 202 of the housing 2 for being received in a corresponding through hole of the circuit board.

The base portion 20 defines a pair of openings 23 at opposite longitudinal ends thereof and a pair of receiving spaces 24 extending from a top face 204 thereof toward the bottom mounting face 202 and communicating with the openings 23. Each receiving space 24 defines a lead-in 240 for guiding the insertion of the board lock 5. The mating portion 22 defines a pair of slots 25 in side surfaces 225 thereof communicating with the receiving spaces 24.

The first and the second terminals 3, 4 are respectively received in the first and the second passageways 221, 223 of the housing 2. The first terminals 3 comprise first mating portions 30 projecting into the first receiving cavity 220 and first press-fit portions 32 extending downwardly beyond the bottom mounting face 202 for being press-fitted in through holes of the circuit board. The second terminals 4 comprise second mating portions 40 projecting into the second receiving cavity 222 and second press-fit portions 42 extending downwardly beyond the bottom mounting face 202 for being press-fitted in the through holes of the circuit board.

Each board lock 5 is stamped from a metal blank and comprises a planar body portion 50 with barbs 500 formed on opposite ends thereof, a beam portion 52 extending upwardly and inwardly from a top of the body portion 50 and a compliant portion 54 extending downwardly from a bottom of the body portion 50. The compliant portion 54 and the body portion 50 are arranged in a common plane. In the preferred embodiment of the present invention, the compliant portion 54 is a press-fit portion.

Figure 5:
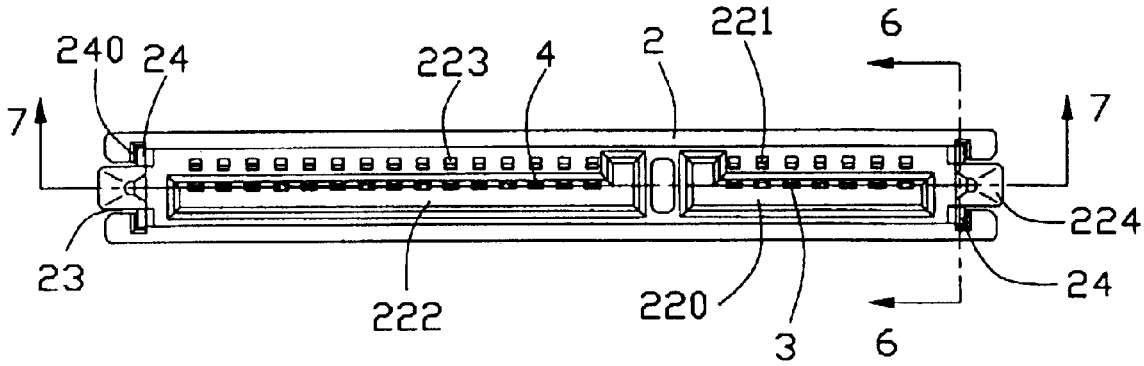
FIG. 5 is a top planar view of the electrical connector shown in FIG. 3.
Figure 6:
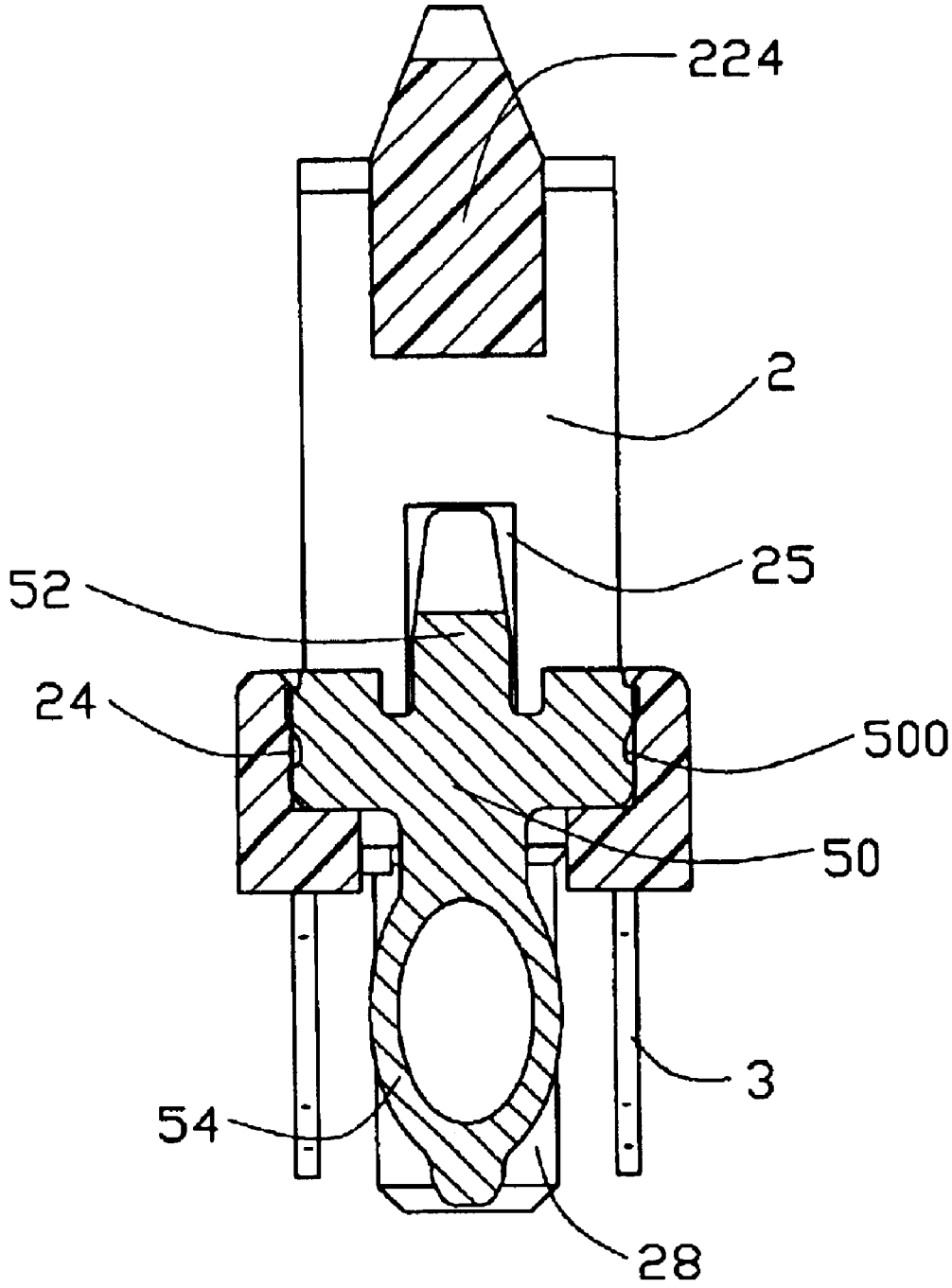
FIG. 6 is a cross-sectional view of the electrical connector taken along line 6—6 in FIG. 5.
Figure 7:
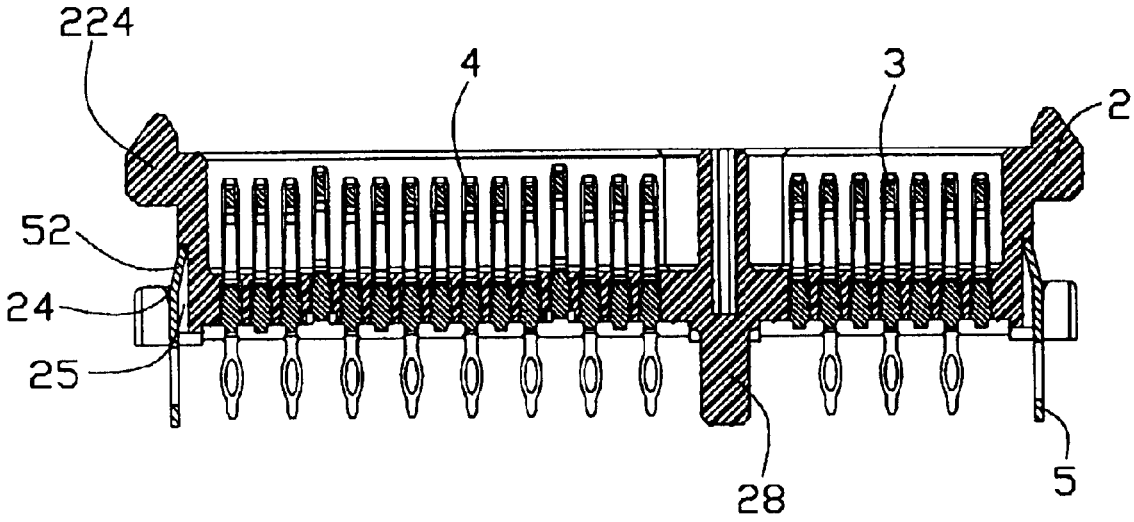
FIG. 7 is a cross-sectional view of the electrical connector taken along line 7—7 in FIG. 5.

Referring to FIGS. 5–7 in conjunction with FIGS. 1 and 2, the board locks 5 are secured on the opposite ends of the housing 2. The board locks 5 are first moved toward the side faces 224 of the housing 2 via the openings 23 and then moved downwardly with the body portions 50 received in the receiving spaces 24 and with the beam portions 52 received in the slots 25. The board locks 5 are retained in the housing 2 via an interferential engagement between the barbs 500 of the body portion 50 and the receiving space 24. The compliant portions 54 extend downwardly beyond the bottom mounting face 202 for being inserted into corresponding through holes of the circuit board.

When the connector 1 is mounted to the circuit board, the compliant portions 54 are compressed inwardly upon insertion of the board locks 5 into the through holes of the circuit board and then resile outwardly to engage surfaces within the through holes, whereby the connector 1 is secured on the circuit board.

Because the beam portions 52 of the board locks 5 are received in the slots 25 of the housing 2, the board locks 5 are prevented from being pushed out from the housing 2 during the insertion of the compliant portions 54 into the through holes of the circuit board. Thus, the connector 1 is reliably secured on the circuit board via the board locks 5.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulating housing defining a receiving space and a slot offsetting from the receiving space in a horizontal direction and communicating with the receiving space;

a plurality of terminals retained in the insulating housing; and a board lock comprising a body portion received in the receiving space of the housing, a compliant portion extending from the body portion and a beam portion extending from the body portion opposite to the compliant portion, the beam portion being received in the slot of the housing for preventing the board lock from being pushed out from the housing wherein the housing comprises a base portion and a mating portion extending upwardly from the base portion, and wherein the receiving space is defined in a top face of the base portion and the slot is defined in an end face of the mating portion.

2. The electrical connector as claimed in claim 1, wherein the receiving space defines a lead-in for guiding the insertion of the board lock thereinto.

3. The electrical connector as claimed in claim 1, wherein the body portion of the board lock defines barbs at opposite ends thereof to have an interferential engagement with the receiving space.

4. The electrical connector as claimed in claim 6, wherein the compliant portion is a press-fit portion.

5. The electrical connector as claimed in claim 1, wherein the beam portion extends upwardly and inwardly from the body portion.

6. The electrical connector as claimed in claim 5, wherein the compliant portion extends downwardly from the body portion, and wherein the compliant portion and the body portion are arranged in a common plane.

7. An electrical connector comprising:

an elongated insulative housing defining a base portion with a mating portion upwardly extending therefrom, a guiding block formed at one end of the mating portion;

an opening formed between the guiding block and a corresponding end portion of the base portion in a vertical direction;

a receiving space formed in the corresponding end portion and under the guiding block;

a slot formed in the end of the mating portion in communication with the opening and located beside said receiving space; and a metallic board lock including a body portion received in the corresponding receiving space, a board engaging portion extending downwardly beyond a bottom surface of the base portion, and a beam portion being offset from said body portion and latchably engaged within the slot; wherein said board lock is substantially located under the guiding block; wherein said slot communicates with an exterior downwardly.

8. A method of making an electrical connector, comprising the steps of:

providing an elongated insulative housing with a base portion equipped with a mating portion upwardly extending therefrom, forming a guiding block at one end of the mating portion;

providing an opening between the guiding block and a corresponding end portion of the base portion in a vertical direction;

forming a receiving space in the corresponding end portion and under the guiding block;

forming a slot in the end of the mating portion in communication with the opening and located beside said receiving space; and providing a metallic board lock with a body portion, a board engaging portion extending downwardly from the body portion, and a beam portion being offset from said body portion;

downwardly inserting the board lock into the opening until the body portion is received in the receiving space, and the beam portion is received in the slot; wherein said board lock is substantially located under the guiding block wherein said slot communicates with an exterior downwardly.

* * * * *